US008419156B2

(12) United States Patent
Ito et al.

(10) Patent No.: US 8,419,156 B2
(45) Date of Patent: Apr. 16, 2013

(54) IMAGE FORMING APPARATUS CAPABLE OF EFFECTIVELY DAMPING VIBRATION

(75) Inventors: Yoichi Ito, Tokyo (JP); Akiyoshi Tanaka, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 272 days.

(21) Appl. No.: 12/964,238

(22) Filed: Dec. 9, 2010

(65) Prior Publication Data

US 2011/0141181 A1 Jun. 16, 2011

(30) Foreign Application Priority Data

Dec. 14, 2009 (JP) ..... 2009-282739

(51) Int. Cl.
*B41J 29/38* (2006.01)
*B41J 2/01* (2006.01)

(52) U.S. Cl.
USPC ..... 347/16; 347/101

(58) Field of Classification Search ..... None
See application file for complete search history.

(56) References Cited

U.S. PATENT DOCUMENTS

| | | | | |
|---|---|---|---|---|
| 7,416,178 | B2 * | 8/2008 | Ito | 271/3.14 |
| 7,744,080 | B2 * | 6/2010 | Shimoohsako | 271/97 |
| 2003/0048325 | A1 | 3/2003 | Ikeda | |
| 2005/0168507 | A1 | 8/2005 | Ide et al. | |
| 2006/0065808 | A1 | 3/2006 | Chee et al. | |
| 2008/0074720 | A1 | 3/2008 | Chee et al. | |

FOREIGN PATENT DOCUMENTS

| | | | |
|---|---|---|---|
| CN | 1251810 | A | 5/2000 |
| CN | 101480884 | A | 7/2009 |
| EP | 1291191 | A1 | 3/2003 |
| EP | 1559560 | A2 | 8/2005 |
| EP | 1764229 | A2 | 3/2007 |
| EP | 1764229 | A2 * | 3/2007 |
| JP | 60-224567 | | 11/1985 |
| JP | 3-256772 | | 11/1991 |
| JP | 2001-138499 | | 5/2001 |
| JP | 2002-172825 | | 6/2002 |
| JP | 4390508 | | 10/2009 |
| JP | 2010-64469 | | 3/2010 |

OTHER PUBLICATIONS

May 20, 2011 European search report in connection with counterpart European patent application No. 10 19 4567.

* cited by examiner

*Primary Examiner* — Geoffrey Mruk
*Assistant Examiner* — Bradley Thies
(74) *Attorney, Agent, or Firm* — Cooper & Dunham LLP

(57) ABSTRACT

An image forming apparatus includes a sheet amount detector to detect an amount of sheets accommodated in the sheet feeding tray, an ejected sheet amount detector to detect an amount of sheets ejected onto the sheet ejection tray, and a vibration damper to damp vibration of the image forming apparatus caused by movement of the carriage. A controller is provided to control the vibration damper to damp vibration of the image forming apparatus in accordance with respective amounts of sheets and ejected sheets detected by the sheet amount detector and the ejected sheet amount detector in prescribed acceleration and deceleration regions of the carriage.

10 Claims, 5 Drawing Sheets

IMAGE FORMING APPARATUS CAPABLE OF EFFECTIVELY DAMPING VIBRATION

CROSS-REFERENCE TO RELATED APPLICATIONS

This application claims priority pursuant to 35 USC §119 to Japanese Patent Application No. 2009-282739, filed on Dec. 14, 2009, the entire contents of which are hereby incorporated by reference herein.

BACKGROUND OF THE INVENTION

1. Field of the Invention

The present invention relates to an image forming apparatus that employs an ink jet system capable of forming an image by ejecting ink drops from a printing head mounted on a carriage onto a sheet.

2. Discussion of the Background Art

In a conventional image forming apparatus that employs an ink jet system (e.g. an inkjet printer), an image is formed by ejecting ink drops from a printing head mounted on a reciprocating carriage onto a sheet. Then, an inertial force is caused when the carriage is either accelerated or decelerated thereby vibrating an apparatus body. Especially, to increase a printing velocity, a velocity of the carriage is increased, and accordingly acceleration and deceleration become sharp. As a result, the apparatus body becomes largely vibrated and makes a user uncomfortable. Further, in a copier in which a scanner unit is mounted on a printer, vibration of the printer impacts scanning of a carriage and degrades image reading. Then, the below-described known countermeasures against the vibration have been taken, in which the object is to smooth out vibration profiles during times of acceleration and deceleration of the carriage. Alternatively, a notch filter or the like is used to filter some of a frequency band inputted to the apparatus, or a separate actuator is employed.

An apparatus generally has a prescribed natural vibration frequency in each of various modes, such as a deflection mode, a twisting mode, etc. Thus, the apparatus largely vibrates at the prescribed natural vibration frequency in response to an input having the same natural vibration frequency as the apparatus. The above-described notch filter prevents resonance of the apparatus at the natural vibration frequencies by avoiding an input having the same natural vibration frequency as that of the machine.

However, when a sheet moves up and down with respect to a carriage serving as a vibration source, a balance between mass of sheets ejected and stacked on a sheet ejection tray arranged on the top of the apparatus and that remaining in the sheet feeding tray arranged in the lower portion of the apparatus than the carriage changes significantly. In such a construction, a natural vibration frequency and a gravity center of the apparatus also change significantly in relation to the carriage. Further, since a natural vibration frequency also changes significantly when acceleration of the carriage is decreased or a notch filter is used, a band to avoid such an input becomes significantly wider, and acceleration of the carriage is late, so that both productivity and a width of the apparatus decrease. Similarly, when the other actuator damps vibration, and a natural vibration frequency and a gravity center of an apparatus change significantly, vibration-damping effectiveness is degraded.

In Japanese Patent Application Laid Open Numbers 2001-138499 and 2005-081673 (JP-2001-13849-A and JP-2005-081673-A, respectively), it is described that a vibration damper having the same mass as the carriage is attached to a timing belt that moves the carriage, and the carriage and the vibration damper are oppositely moved to damp the vibration of the carriage.

Further, in Japanese Patent Application Laid Open Number H3-256772 (JP-H03-256772-A), it is described that a scanning mechanism other than a scanning mechanism that moves a printing head is employed. The other scanning mechanism includes a weight having substantially the same mass as the printing head and is moved at the same acceleration as the printing head but in the opposite direction.

However, these conventional techniques do not effectively damp the vibration of the apparatus considering the up and down movement of a gravity center of the apparatus as well as a large change in natural frequency thereof when a sheet moves up and down with respect to the carriage serving as a vibration source as mentioned above.

SUMMARY OF THE PRESENT INVENTION

Accordingly, an object of the present invention is to provide a new and novel image forming apparatus including a sheet amount detector to detect an amount of sheets accommodated in the sheet feeding tray, an ejected sheet amount detector to detect an amount of sheets ejected onto the sheet ejection tray, and a vibration damper to damp vibration of the image forming apparatus caused by movement of the carriage. A controller is also provided to control the vibration damper to damp vibration of the image forming apparatus in accordance with respective amounts of sheets and ejected sheets detected by the sheet amount detector and the ejected sheet amount detector in prescribed acceleration and deceleration regions of the carriage.

In another aspect, the controller changes acceleration of the vibration damper in accordance with a printer mode in addition to the respective amounts of sheets and ejected sheets. The printer mode at least includes a high velocity mode, a normal mode, and a high quality mode.

In yet another aspect, the controller changes acceleration of the vibration damper in accordance with an acceleration of the carriage in addition to the respective amounts of sheets and ejected sheets.

In yet another aspect, detection result of the sheet amounts and the ejected sheet amounts is classified by the controller into first to fourth regions. The first region represents that the sheet amount is equal to or less than a prescribed first level and the ejected sheet amount is equal to or less than a prescribed second level, the second region represents that the sheet amount is more than the prescribed first level and the ejected sheet amount is equal to or less than the prescribed second level, the third region represents that the sheet amount is more than the prescribed first level and the ejected sheet amount is more than the prescribed second level, and the fourth region represents that the sheet amount is equal to or less than the prescribed first level and the ejected sheet amount is more than the prescribed second level. The controller changes the acceleration of the vibration damper in accordance with the first to fourth regions.

In yet another aspect, the sheet amount detector detects an amount of sheets accommodated in the sheet-feeding tray at every printing completion. The ejected sheet amount detector detects an amount of ejected sheets ejected onto the sheet ejection tray at every printing completion.

In yet another aspect, the controller stops operation of the vibration damper when the carriage moves at a uniform velocity region. In yet another aspect, mass of the vibration damper is smaller than that of the carriage. In yet another aspect, a moving range of the vibration damper is narrower than that of the carriage.

In yet another aspect, the controller stops controlling the vibration damper when recognizing the second region in the high quality mode. In yet another aspect, the controller changes the acceleration of the vibration damper only in the fourth region in the high quality mode.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
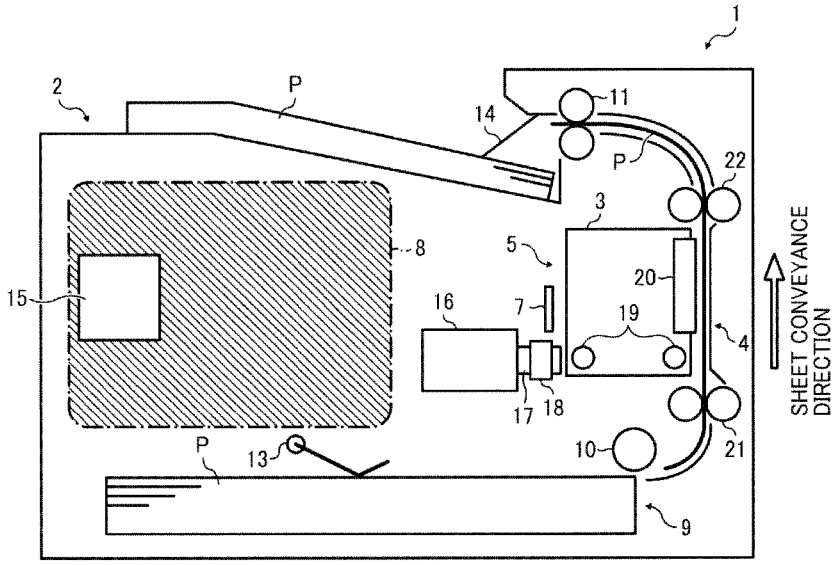
FIG. 1 illustrates a principal part of an image forming apparatus including a vibration damping mechanism according to one embodiment of the present invention.

Referring now to the drawings, wherein like reference numerals designate identical or corresponding parts throughout several views, in particular in FIG. 1, an exemplary principle part of an image forming apparatus, such as an ink jet printer, etc., including a vibration damping mechanism 15 is described. The image forming apparatus 1 at least includes a sheet feeder 9 of a sheet feeding tray provided in the lower section to accommodate sheets P, a sheet ejector 2 of a sheet ejection tray provided in the upper section to stack sheets P ejected after image formation is executed, and a sheet conveyance path 4 arranged almost vertically from down to up sides from the sheet feeder 9 to the sheet ejector 2. Also included is an image formation section 05 that forms an image on a sheet P conveyed onto the sheet conveyance path 4.

A sheet amount detector is provided in the sheet feeder 9 to detect an amount of sheets accommodated and stacked therein. The sheet amount detector includes a swingable sheet detection lever 13 changing an angle thereof in accordance with a sheet-stacking amount thereon. Thus, a sheet-stacking amount can be detected by detecting the angle. An ejected sheet amount detector is provided in the sheet ejector 2 to detect an amount of ejected and stacked sheets passing through the sheet ejection roller 11. The sheet amount detector includes a swingable sheet detection lever 14 capable of changing its angle in accordance with a sheet-stacking amount thereon. Thus, a sheet-stacking amount can be detected by detecting the angle.

Instead of the sheet detection levers 13 and 14, sensors, not shown, measuring weight, such as a strain gauge, etc., can be arranged on the bottom of the sheet feeder 9 and the sheet ejector 2 to detect an amount of the sheets by detecting mass thereof. When the sheet amount (not a thickness) of stacked sheets is directly detected, a lever can be omitted in the sheet ejector 9. As a result, problems such as partial deviation of the sheet from the lever, breakage of the lever, etc., can be avoided. Further, the vibration damping mechanism 15 can be more precisely controlled due to direct detection of mass, which is more essential to a natural frequency and gravity center When printing starts, sheets P piled up on the sheet feeder 9 are initially launched being separated one by one by a sheet feeding roller 10 and a separator, not shown. Then, a pair of conveyance rollers 21 and 22 pinches the sheet. The sheet is then conveyed toward an image formation region in the image formation section 5 in a sheet conveyance direction (i.e., a sub scanning direction) as shown by arrow in the drawing.

The image formation section 5 includes a carriage 3 and a carriage driving mechanism. The carriage 3 accommodates a printing head 20 and is located at one side of the apparatus, so that the printing head 20 is arranged outside (i.e., on the right side of) the sheet ejection roller 11 and the sheet-feeding roller 10. The printing head 20 is connected to a control substrate, not shown, by a flexible cable, not shown, drawn out from the carriage 3. The carriage 3 is reciprocated by a carriage driving mechanism in a main scanning direction (e.g. a sheet penetration direction in FIG. 1) perpendicular to a sub scanning direction, in which the sheet P is conveyed. The carriage driving mechanism includes a pulley connected to a main scanning motor 16, a driven pulley 23 (see FIG. 2) arranged facing the driving pulley 17, a timing belt 18 with a teeth portion wound around these pulleys 17 and 23, and a guide rail 19 extending in the main scanning direction. The carriage 3 is secured to the timing belt 18.

When the pulley 17 rotates as the motor 16 operates, the carriage secured to the timing belt 18 starts scanning in the main scanning direction. The guide rail 19 has a pair of parallel round bar penetrating respective insertion holes formed in the carriage 3, respectively. The carriage 3 thus slides along the pair of guide rollers 19. When a rotational direction of the motor is changed, a movement direction of the carriage 3 can be changed. Similarly, when a number of rotations of the motor is changed, a movement velocity of the carriage 3 can be changed.

The flexible cable serves as an image signal-transmitting device from the control substrate, and is produced by printing a wiring pattern on a film having flexibility. The flexible cable thus transmits data between the carriage 3 and the control substrate 3 while following the movement of the carriage 3. An encoder 7 is provided beside the carriage 3 along the main scanning direction. The encoder 7 is made of transparent resin having marks of scales at a prescribed interval. By detecting the scales using an optical sensor arranged on the carriage 3, a position of the carriage 3 can be detected.

The printing head 20 is arranged facing the sheet P between a pair of rollers 21 and 22. On a surface of the printing head facing the sheet P, there is provided ink ejection openings. When the sheet P is conveyed by the pair of conveyance rollers 21 and 22 to a section where it faces the printing head 20, ink drops are ejected toward the sheet P (from left to right in FIG. 1) from the ink ejection openings in accordance with image signal transmitted from the control substrate. Thus, a prescribed desired mage can be obtained.

In this way, by moving the sheet P in the sub scanning direction and the carriage 3 having the head 20 with the ink ejection (discharge) openings in the main scanning direction, an image is formed on the sheet P. Further, the sheet P having been subjected to image formation is ejected by a pair of sheet ejection rollers 11 to the sheet ejector 2 provided on a top of the apparatus with its image surface facing down.

While the carriage 3 is accelerated toward a printing region of a sheet and reaches a prescribed velocity, and the carriage 3 is decelerated so that the prescribed velocity decreases down to zero after passing through the printing region, the apparatus receives an inertial force from the carriage 3, thereby vibrating the apparatus.

Further, in a system where a sheet feeder 9 and a sheet ejector 2 are arranged above and below the carriage 3 serving as a vibration source in the image forming apparatus of FIG. 1, due to a difference in piling up amounts of sheets P in both of the sheet feeder 9 and the sheet ejector 2, mass of the sheets P changes significantly above and below the carriage 3. Thus, since a natural vibration frequency and a gravity center of the apparatus change significantly, a conventional vibration damping system cannot effectively damp vibration of the apparatus. Accordingly, in one embodiment of the present invention, an amount of sheets in each of a sheet feeder 9 and a sheet ejector 2 is detected and the detection result is fed back to the vibration damping mechanism 15 for controlling.

As shown in FIG. 1, the vibration damping mechanism 15 is arranged on the left side in the apparatus. A control substrate and a power supply substrate are arranged in a region shown by slanted lines. However, component members needed for image formation are concentrated on a side (e.g. a right side in the drawing) where the carriage 3 and a maintenance recovery mechanism, not shown, that keeps the printing head clear, and the like are arranged. Accordingly, since (total) mass of the substrate or the like is relatively lighter than the above-described members, a gravity center of the apparatus is necessarily located on the right side in the drawing. By contrast, by arranging the vibration damping mechanism 15 in the slanted line section 80, the gravity center of the apparatus is shifted to the left side in the drawing, so that the apparatus is balanced. In this way, when a principal component member arranged on one side is heavy, and a gravity center of the apparatus far shifted to the side, by arranging the vibration damping mechanism 15 in the opposite side as far as possible, the gravity center is shifted to a center of the apparatus, so that the apparatus can be stable. For example, the vibration damper 15 is arranged in a space other than the slanted line section 8 where a control substrate and a power supply substrate are arranged.

Figure 2:
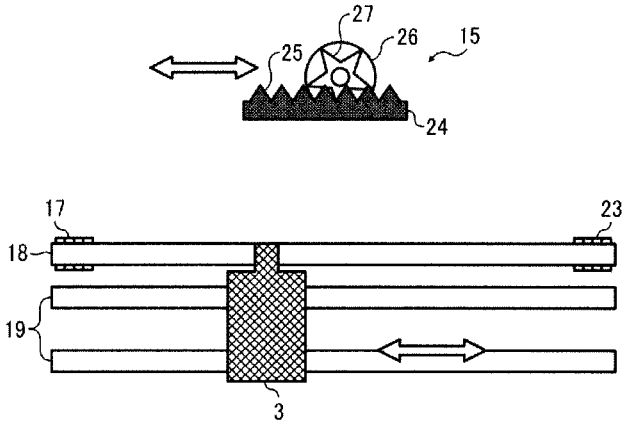
FIG. 2 illustrates an exemplary vibration damping mechanism according to one embodiment of the present invention.

Now, an exemplary configuration of the vibration damper 15 of one embodiment of the present invention is specifically described with reference to FIG. 2. The vibration damper 15 is movably arranged in the main scanning direction in that the carriage 3 moves, and includes a vibration damper 24 having a teeth section 25, such as a rack, etc., and another driving device 26 having a meshing member 27, such as a pinion, etc., separated from the main scanning motor 16. Thus, when the other driving device 26 rotates and the meshing member 27 of the other driving device 26 meshes with the teeth section 25 of the vibration damper 24, the vibration damper 24 is moved in the main scanning direction as mentioned above. In this way, by driving the vibration damper with the other driving device than that for the carriage, load on the device for driving the carriage does not increase. Further, the vibration damper can be finely and independently controlled from the carriage.

At that time, when the carriage 3 moves in the main scanning direction, i.e., to left in the drawing, the vibration-damper 24 is moved rightward. By contrast, when the carriage 3 moves to right in the drawing, the vibration-damper 24 is moved leftward. As a result, opposite acceleration to that applied to the carriage 3 is applied all the time to the vibration-damper 24. Accordingly, each of inertial forces caused by the carriage 3 and the vibration-damper 24 and applied to the apparatus is also opposite all the time, it is either reduced or cancelled.

Specifically, by equalizing the respective accelerations of the carriage 3 and the vibration damper 24 when the respective mass of those are the same in consideration of formula (F (inertial force)=m (mass)×a (acceleration)), the same but opposite directional inertial force can be generated. Further, by increasing the acceleration of the vibration damper 24 greater than that of the carriage 3 when the mass of the vibration damper 24 is less than that of the carriage 3, the same but opposite directional inertial force can similarly be generated.

Further, since the carriage 3 and the vibration damper 24 move in parallel to each other, a wasteful force is not generated, and accordingly the inertial force in a direction capable of canceling that of the carriage 3 can be directly and effectively applied to the apparatus body. It should be noted that the vibration damping mechanism 15 can be positioned at the same height as the carriage 3 or above the same.

Further, the inertial force is only generated among the movement region of the carriage 3 when the carriage 3 is accelerated or decelerated as different when moving at the uniform velocity motion. Thus, a movement region of the vibration damper 24 is not necessarily the same as that of the carriage 3 due to driving by the separate driving device 26, and is only necessitated to move in a region corresponding to when the carriage 3 is accelerated and decelerated. Accordingly, the vibration damper 15 can be designed to move in a narrower region than the carriage 3, and thereby the apparatus can be made more compact and energy efficient.

Figure 3:
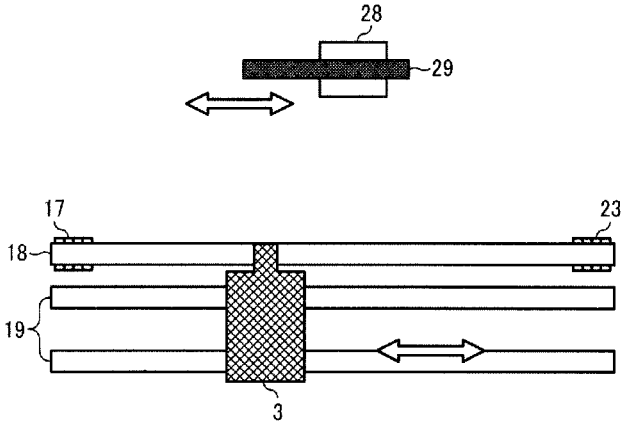
FIG. 3 illustrates another exemplary vibration damping mechanism according to one embodiment of the present invention.

Now, another exemplary embodiment of a vibration-damper 15 according to the present invention is described with reference to FIG. 3. The carriage 3 and the main scanning mechanism have the same configurations as described above. However, according to this embodiment, the vibration damper 15 includes a solenoid 28 serving as another driving device different from the main scanning motor 16, and a vibration damper 29 serving as an iron core (e.g. a plunger) of the solenoid 28. Thus, by driving the solenoid 28, the vibration damper 29 is moved in the main scanning direction (i.e., a direction shown by an arrow). At that moment, similar to the above, when the carriage 3 is moved leftward in the drawing, the vibration damper 29 is move rightward. Whereas when the carriage 3 is moved rightward in the drawing, the vibration damper 29 is moved leftward. As a result, the inertial force applied to the apparatus can be either reduced or cancelled. Further, since the vibration damper 15 is formed from the solenoid 28 and the vibration damper 29 serving as the plunger, a configuration of the vibration damper 15 is simplified decreasing numbers of parts thereof.

Now, an exemplary controller for controlling the carriage 3 and the vibration damper 15 is described with reference to FIG. 4. The printer controller 51 receives image data 50 from an external information processing apparatus, such as a personal computer and an image reader or the like, and control the printing head 20 to eject ink drops to form an image on a sheet in accordance with the image data. The main scanning controller 53 calculates a control amount (e.g. a PI control amount) based on a deviation amount of a current velocity from a target velocity in accordance with a velocity profile of the carriage 3 stored in a velocity profile storage 54 as shown in FIG. 5 and an output from the encoder 7 (shown in FIG. 1) that detects a position of the carriage 3 in the main scanning direction. The main scanning controller 53 then controls the main scanning motor 16 to drive via a motor driving section 55, so that the carriage 3 is moved to execute scanning in the main scanning direction at a prescribed velocity.

The carriage 3 may move reciprocally in accordance with a velocity profile like that shown in FIG. 5. Specifically, premising that a positive value is assigned in an outward motion, the carriage 3 is accelerated to reach a velocity of 2.2 m/s from that of 0 m/s and executes a uniform motion there. During the uniform motion, liquid drops are ejected onto a printing region of a sheet by scanning thereof, so that an image is formed. The carriage 3 is controlled in the same way as mentioned above on a return path. In such a situation, an inertial force is present during acceleration and deceleration of the carriage 3 in relation to the apparatus, and is absent during the uniform motion. Further, a level of acceleration of the carriage 3 depends on a printer mode designated by an operator through a personal computer or an operation panel of an apparatus. Specifically, the level is large in a high-velocity mode, intermediate, in a normal mode, and small, in a high quality mode, respectively. Vibration value of the apparatus is proportional to the level of the acceleration, such that it is large when the level is large, intermediate when the level is intermediate, and small when the level is small. Thus, an acceleration level of the vibration damper is determined depending on the printing mode.

Figure 4:
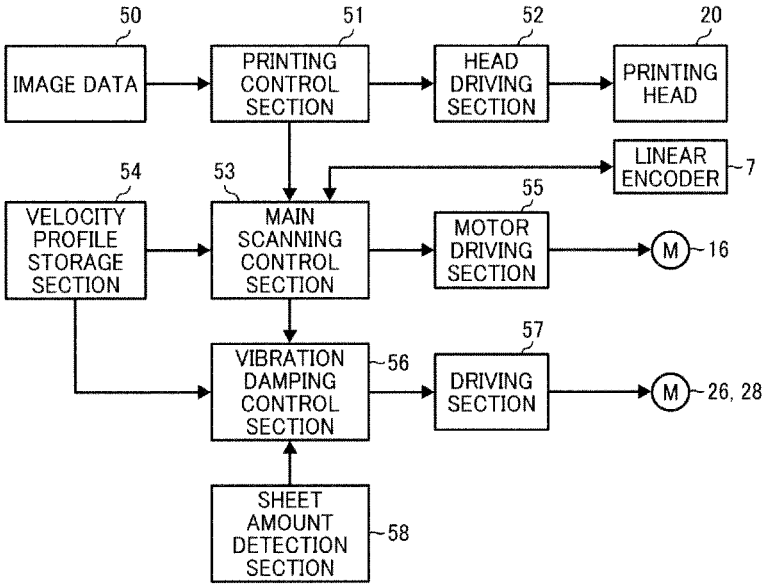
FIG. 4 illustrates an exemplary controller for controlling a carriage vibration damping mechanism according to one embodiment of the present invention.
Figure 5:
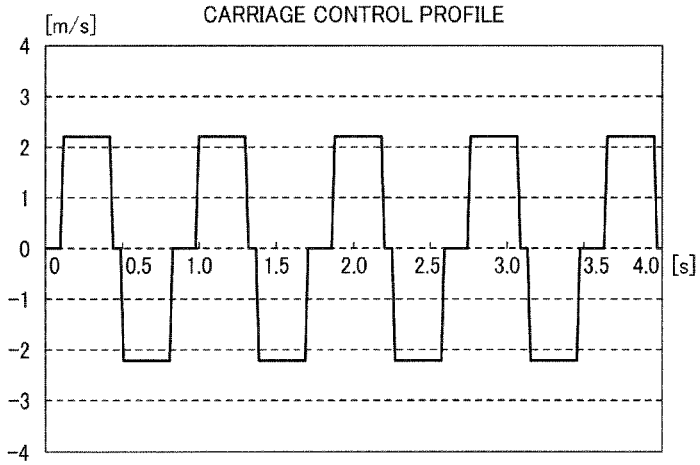
FIG. 5 illustrates an exemplary velocity profile of the carriage according to one embodiment of the present invention.

Further, as shown in FIG. 4, when the main scanning controller 53 controls the carriage 3 to move in a main scanning direction at a velocity corresponding to a printing mode, the vibration damping controller 56 that controls the vibration damper 15 executes vibration damping control of the apparatus during acceleration and deceleration of the carriage 3. Specifically, the vibration damping controller 56 controls the other driving devices 26 and 28 via the driving section 57 and accelerates and decelerates the vibration dampers 24 and 28 in accordance with a profile of the carriage stored in a velocity profile storage 54 according to a printer mode and an amount of sheets of each of the sheet feeding and ejectors 9 and 2 detected by a sheet amount detector 28.

Thus, the vibration damping controller 56 monitors the respective sheet amounts of the sheet feeding and receiving sections 9 and 2, because the natural vibration frequency and the gravity center significantly change in accordance with the respective sheet amounts as mentioned above. Assuming that a contact between the apparatus and an installation surface is a fulcrum and a gravity center of the apparatus vibrates as the carriage vibrates, the harder the apparatus vibrates, the closer the gravity center approaches the fulcrum, and the easier the apparatus vibrates, the far the gravity center is separated from the fulcrum. Specifically, the larger the mass of the sheet feeder 9, the harder the apparatus vibrates, and the larger the mass of the sheet ejector 2, the easier the apparatus vibrates.

Figure 6:
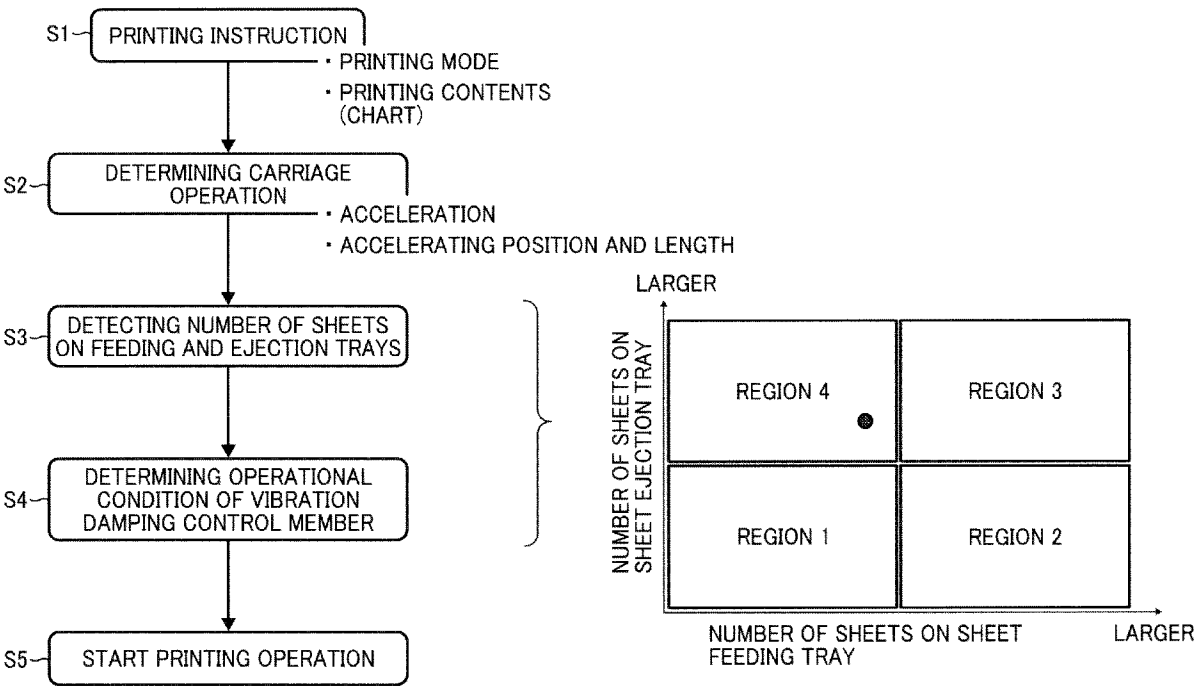
FIG. 6 schematically illustrates an exemplary sequence of vibration damping control executed in the image forming apparatus and exemplary easiness of vibration of the image forming apparatus in accordance with amounts of sheets stacked on the sheet feeding and ejection trays according to one embodiment of the present invention.

Now, with reference to the right side drawing of four conditional first to fourth regions in FIG. 6, tendency of vibration of the apparatus in accordance with a number of sheets of each of the sheet ejection and feeding trays are described. As shown, when many sheets are stacked on the sheet ejection tray, and a small number of sheets are stacked on the sheet-feeding tray in the fourth region thereby the gravity center shown by a mark being located therein, acceleration of the vibration-damper is necessarily bigger considering the mass of the vibration damper, because the vibration of the apparatus becomes relatively large. Whereas when a small number of sheets are stacked on the sheet ejection tray, and many sheets are stacked on the sheet-feeding tray in the second region, acceleration of the vibration damper may be small because the vibration of the apparatus is small. Vibration of the apparatus in each of the first and third regions is between those of the fourth and second regions. Further, when the high quality mode is designated as a printer mode and sheet stacking numbers if the sheet feeding and ejection trays as in the second region, the vibration damper is not driven, and accordingly vibration damping control is not necessarily executed, because acceleration and velocity of the carriage are relatively small in the high quality mode and vibration of the apparatus is also small as in the second region.

Now, an exemplary sequence of the vibration damping control of the apparatus is described with reference to the flow chart shown on the left in FIG. 6. When an operator provides a printer instruction designating a printer mode and printing contents in step S1, the main scanning controller 53 determines acceleration, an acceleration start position, and acceleration time period of a carriage in accordance with the printer mode and contents. Almost at the same time, the sheet amount detector 58 detects an amount of sheets on the sheet feeding and ejection trays in step S3. Then, acceleration, an acceleration start position, and an acceleration time period of a vibration damper is determined in accordance with those of the carriage by the vibration damping controller 56 and the amount of sheets on the sheet feeding and ejection trays in step S4.

At this moment, the number of sheets on each of the sheet feeding and ejection trays is detected, the above-described four regions are then considered, and an operating condition of the vibration damper is determined. The above-described determination of one of the four regions can be executed based on a sheet number (e.g. 100 sheets) produced at high velocity when an operator designates. Alternatively, it may be determined at every sheet printing during the printing. Finally, the carriage starts a printing operation while operating the vibration damper in step S5.

Figure 7:
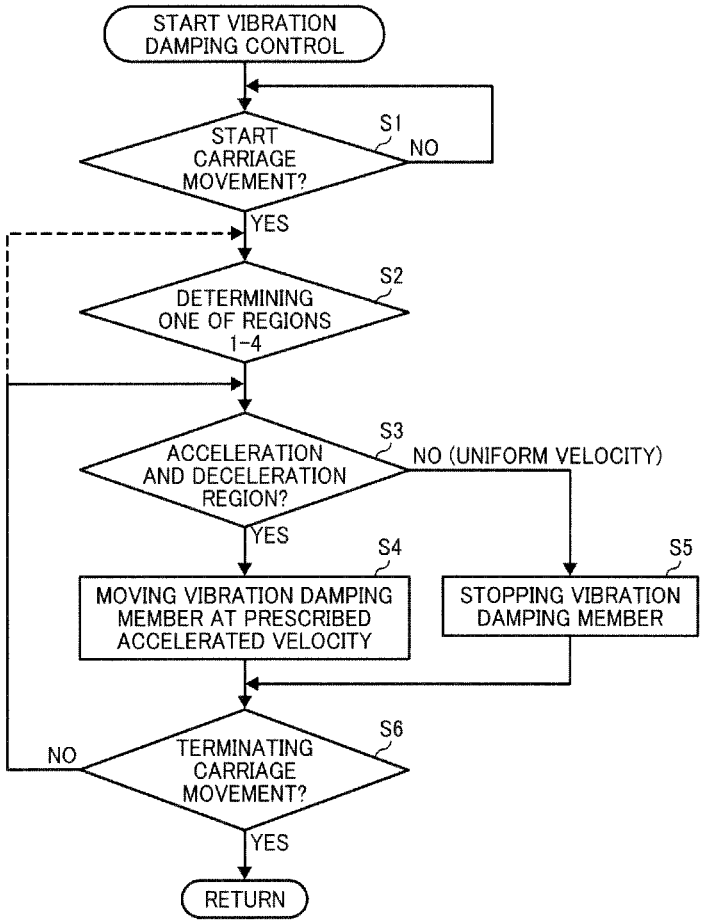
FIG. 7 illustrates an exemplary sequence of control executed by the vibration-damping controller.

Now, an exemplary control sequence executed by the vibration controller 56 is described with reference to FIG. 7. When the main scanning controller 53 controls the carriage to start main scanning movement at an acceleration in accordance with a printing mode in step S1, the vibration controller 56 determines an acceleration and an acceleration time period of the vibration damper in accordance with a number of sheets on each of the sheet feeding and ejection trays detected by the sheet amount detector 58, specifically with reference to the above-described four regions in step S2. The vibration controller 56 then determines if the carriage belongs to acceleration and deceleration regions in accordance with the velocity profile stored in the velocity profile storage 54 in step S3. The vibration controller 56 controls the vibration damper to move in a direction capable of canceling vibration of the apparatus caused by inertial force, which is generated by the carriage movement, at a prescribed acceleration and an acceleration time period determined in accordance with an acceleration of the carriage, when the carriage belongs to the acceleration and deceleration region. The vibration controller 56 controls the vibration damper to stop moving when the carriage belongs to a uniform velocity region in step S5.

The sequence returns to step S3, and the vibration controller 56 repeats vibration control when the movement of the carriage is not completed.

However, a number of sheets on the sheet feeding and ejection trays and weight thereof are significantly different between first sheet and $100^{th}$ sheet when 100 sheets are printed. Further, since some amount of sheets is extracted from the sheet feeding and ejection trays during printing, determination of the region can vary. Thus, belonging to one of four regions can be determined (as shown by a dotted line arrow) returning to step S2 per one or multiple number of sheet printings. As a result, acceleration of the vibration damper can be more precisely determined.

In this way, a motor for driving the vibration damper is controlled to move the vibration damper to cancel vibration of the apparatus caused by an inertial force generated by the movement of the carriage. At this moment, since another driving device than the motor for the carriage can move the vibration damper, and accordingly, the vibration damper does not need to be driven by the motor for the carriage, load on the motor driving the carriage does not increase. In addition, since the vibration damper can be controlled in dependent from the carriage, fine control can be achieved. Further, by providing an encoder in the driving device of the vibration damper, finer control can be achieved.

Further, since an impactive force F is calculated by the following formula, mass of the vibration damper can be smaller than that of carriage, and almost the same impactive force F can be obtained if an acceleration is increased in proportion thereto;

$$F = \text{mass} \times \text{acceleration}.$$

As a result, vibration of the apparatus caused by the inertial force of the carriage can be cancelled. Further, by making the vibration damper light and compact, increase of the mass and a size of the whole apparatus can be minimized.

Since the vibration damper is moved to damp vibration during acceleration and deceleration of the carriage, and is stopped when the carriage moved at uniform velocity motion, the vibration damper does not moves when an image is formed. As a result, liquid drops from the printing head do not deviate, which is generally cause by the vibration, thereby quality of an image can be maintained.

The mass of the vibration damper is smaller than that of the carriage and executes vibration control during one of at least acceleration and deceleration times and stops controlling thereof during the uniform velocity in this way, image quality is not affected avoiding increase in mass and a size of the apparatus. Further, vibration can be effectively suppressed even as the carriage moves.

An excursion (locus) of the sheet is not limited to the straight as in the above and can draw a letter S, where the sheet is upwardly conveyed from the sheet feeder and becomes horizontal and is further upwardly conveyed toward the sheet ejection tray passing through the carriage.

Further, the above-described vibration damping mechanism can include a driving device other than the main scanning motor for driving the carriage and a vibration damper linked with the driving device via an arm to swing left and right like a pendulum as the driving device rotates. Further, the sheet can include an OHP or the like and is called a printer medium or sheet, to which ink drops can attach.

Numerous additional modifications and variations of the present invention are possible in latent image of the above teachings. It is therefore to be understood that within the scope of the appended claims, the present invention may be practiced otherwise that as specifically described herein.

ADVANTAGE

Even when a sheet moves up and down than a carriage serving as a vibration source, vibration of an apparatus can be effectively damped.

What is claimed is:

1. An image forming apparatus comprising:

a sheet feeding tray configured to accommodate sheets;

a printing head configured to form an image by ejecting ink drops onto a sheet conveyed from the sheet feeding tray;

a carriage configured to reciprocate in a main scanning direction carrying the printing head, said carriage being arranged above the sheet feeding tray;

a sheet ejection tray configured to stack sheets bearing images formed by the printing head thereon, said sheet ejection tray being arranged above the carriage;

a sheet amount detector configured to detect an amount of sheets accommodated in the sheet feeding tray;

an ejected sheet amount detector configured to detect an amount of sheets ejected onto the sheet ejection tray;

a vibration damper configured to damp vibration of the image forming apparatus caused by movement of the carriage; and a controller configured to control the vibration damper to damp vibration of the image forming apparatus in accordance with respective amounts of sheets and ejected sheets detected by the sheet amount detector and the ejected sheet amount detector in prescribed acceleration and deceleration regions of the carriage.

2. The image forming apparatus as claimed in claim 1, wherein said controller changes acceleration of the vibration damper in accordance with a printer mode in addition to the respective amounts of sheets and ejected sheets, said printer mode at least including a high velocity mode, a normal mode, and a high quality mode.

3. The image forming apparatus as claimed in claim 1, wherein said controller changes acceleration of the vibration damper in accordance with an acceleration of the carriage in addition to the respective amounts of sheets and ejected sheets.

4. The image forming apparatus as claimed in claim 1, wherein a detection result of the sheet amount and the ejected sheet amount is classified by the controller into first to fourth regions, wherein said first region represents that the sheet amount is equal to or less than a prescribed first level and the ejected sheet amount is equal to or less than a prescribed second level, said second region represents that the sheet amount is more than the prescribed first level and the ejected sheet amount is equal to or less than the prescribed second level, said third region represents that the sheet amount is more than the prescribed first level and the ejected sheet amount is more than the prescribed second level, and said fourth region represents that the sheet amount is equal to or less than the prescribed first level and the ejected sheet amount is more than the prescribed second level, and wherein said controller changes the acceleration of the vibration damper in accordance with the first to forth regions.

5. The image forming apparatus as claimed in claim 4, wherein said controller stops controlling the vibration damper in the second region in the high quality mode.

6. The image forming apparatus as claimed in claim 4, wherein said controller changes the acceleration of the vibration damper only in the fourth region in the high quality mode.

7. The image forming apparatus as claimed in claim 1, wherein the sheet amount detector detects an amount of sheets accommodated in the sheet feeding tray at every printing completion, and wherein the ejected sheet amount detector detects an amount of ejected sheets ejected onto the sheet ejection tray at every printing completion.

8. The image forming apparatus as claimed in claim 1, wherein said controller stops operation of the vibration damper when the carriage moves at a uniform velocity region.

9. The image forming apparatus as claimed in claim 1, wherein mass of the vibration damper is smaller than that of the carriage.

10. The image forming apparatus as claimed in claim 1, wherein a moving range of the vibration damper is narrower than that of the carriage.

* * * * *